US008246405B2

(12) United States Patent
Checkley

(10) Patent No.: US 8,246,405 B2
(45) Date of Patent: Aug. 21, 2012

(54) SPORTS BOARD

(75) Inventor: Glenn Andrew Checkley, Clear Island Waters (AU)

(73) Assignee: Lifetime Toys Pty Ltd (AU)

( * ) Notice: Subject to any disclaimer, the term of this patent is extended or adjusted under 35 U.S.C. 154(b) by 214 days.

(21) Appl. No.: 12/758,496

(22) Filed: Apr. 12, 2010

(65) Prior Publication Data

US 2011/0086562 A1 Apr. 14, 2011

(30) Foreign Application Priority Data

Oct. 12, 2009 (AU) ..... 328361
Oct. 12, 2009 (AU) ..... 200913931
Oct. 12, 2009 (AU) ..... 2009905728
Feb. 5, 2010 (AU) ..... 2010200428

(51) Int. Cl.
*B63B 1/00* (2006.01)
*B63B 35/00* (2006.01)

(52) U.S. Cl. ..... 441/65

(58) Field of Classification Search ..... 441/35, 441/65, 67, 74, 79, 129, 136; 114/39.12, 114/39.14, 242, 249, 251, 253, 343, 346
See application file for complete search history.

(56) References Cited

U.S. PATENT DOCUMENTS 3,045,264 A * 7/1962 Smith ..... 441/67
D226,633 S 4/1973 Beck
D232,964 S 9/1974 Beck
D306,631 S 3/1990 Aguilar et al.
6,102,760 A * 8/2000 Seigler ..... 441/65
D447,785 S 9/2001 Fireman et al.
D462,406 S 9/2002 Kessler
D476,390 S 6/2003 Peterson
6,761,602 B1 * 7/2004 Quinn ..... 441/67
6,896,569 B1 5/2005 Wittenrich
D526,379 S 8/2006 Peterson
7,112,168 B2 9/2006 Dalebout et al.
D545,392 S 6/2007 McKee
D562,424 S 2/2008 McKee
D573,220 S 7/2008 Nakpodia
D631,524 S * 1/2011 Slowinski ..... D21/803
D646,738 S 10/2011 Checkley

OTHER PUBLICATIONS

U.S. Appl. No. 29/359,488, mail date Mar. 18, 2011, Office Action.
U.S. Appl. No. 26/359,488, mail date Jun. 8, 2011, Notice of Allowance.
"Charger 41" water sport board, available, on information and belief, at least as early as Jan. 2008, 16 photographs, 4 pages, including assembled and disassembled views.
"Wavestorm" water sport board, available, on information and belief, at least as early as Jan. 2008, 16 photographs, 4 pages, including assembled and disassembled views.

* cited by examiner

*Primary Examiner* — Daniel Venne
(74) *Attorney, Agent, or Firm* — Workman Nydegger

(57) ABSTRACT

A sports board comprises a top surface for supporting a rider, a bottom surface, a leading edge portion and a following edge portion with a central axis extending between the leading edge portion and the following edge portion, a first side edge portion and a second side edge portion located on respective first and second lateral sides of the central axis of the sports board. The lateral width of the sports board between the first side edge portion and the second side edge portion may be equal to, or greater than, the distance between the leading edge portion and the following edge portion. A first-side part of the bottom surface may be inclined upwardly towards the first edge portion, and a second-side part of the bottom surface may be inclined upwardly, in a lateral direction, towards the second edge portion.

26 Claims, 17 Drawing Sheets

1
X
5
2
9
13
20d
19b
11
20b
19a
14
20c
18b
18a
20a
52
26
23
40
7
17
46
45
47

1
2
3
9
16
13
11
12
10
14
32
33
35
15
7
17
45
46
47

SPORTS BOARD

CROSS-REFERENCE TO RELATED APPLICATIONS

This patent application claims priority to and the benefit of: (1) Australian Provisional Patent Application No. 2009905728, filed Oct. 12, 2009, entitled "SKIMDISK", (2) Australian Application Design No. 200913931, now Registration No. 328361, filed Oct. 12, 2009, entitled "SPORTING BOARD FOR SKIING ON VARIOUS SERVICES", and (3) Australian Patent Application No. 2010200428, filed Feb. 5, 2010, entitled "SPORTS BOARD", which claims priority to Australian Provisional Patent Application No, 2009905728, filed Oct. 12, 2009, entitled "SKIMDISK", each of which are incorporated herein, in their entirety, by reference.

TECHNICAL FIELD

The disclosure relates to a sports board for use on, for example, water at the beach.

BACKGROUND

Surfing has been a popular recreational and competition sport for many years, its origins believed to be in the South Pacific with reports of natives of Tahiti surfing as early as 1777. Following the popularity of surfing and the surfboard, other related sports and sporting equipment have emerged including bodyboarding sometimes termed "boogie boarding". In bodyboarding, a shorter still elongate version of a conventional surfboard is used that is designed to support a rider who is lying or sitting on a bodyboard as opposed to standing upright. As the bodyboard is significantly easier to use than a surfboard, it has experienced an increase in popularity over the years.

It is to be understood that, if any prior art publication is referred to herein, such reference does not constitute an admission that the publication forms a part of the common general knowledge in the art, in Australia or any other country.

SUMMARY

According to a first aspect, the present disclosure provides a sports board comprising:

a top surface for supporting a rider and a bottom surface;

a leading edge portion and a following edge portion with a central axis extending between the leading edge portion and the following edge portion;

a first side edge portion and a second side edge portion located on respective first and second lateral sides of the central axis of the sports board, wherein:

the lateral width of the sports board between the first side edge portion and the second side edge portion is equal to, or greater than, the distance between the leading edge portion and the following edge portion.

In an embodiment, the leading edge portion is curved.

In an embodiment, the following edge portion is curved.

In an embodiment of the first aspect, a first-side part of the bottom surface is inclined upwardly, in a lateral direction towards the first edge portion and a second-side part of the bottom surface is inclined upwardly, in a lateral direction towards the second edge portion.

In an embodiment, a more forward part of the bottom surface is inclined upwardly towards the leading edge.

In an embodiment, a more rearward part of the bottom surface is inclined upwardly towards the following edge.

In an embodiment, the bottom surface of the sports board may comprise a center region.

The center region may be substantially flat.

The center region may be convex.

One or more of said inclined bottom surface parts may be inclined upwardly from the center region towards a corresponding edge portion.

In an embodiment the first-side part of the bottom surface is inclined upwardly towards the first edge, the second-side part of the bottom surface is inclined upwardly, in a lateral direction, towards the second edge portion and the more forward part of the bottom surface is inclined upwardly towards the leading edge.

The degree of incline of the more forward part of the bottom surface may be greater than the degree of incline of the first- and second-side parts of the bottom surface.

The more rearward part of the bottom surface may also be inclined towards the following edge.

In an embodiment, the sports board is substantially circular in shape.

In an embodiment, the sports board has a leading edge portion that is substantially straight.

In an embodiment, the sports board has a following edge portion that is substantially straight.

The first and second side edge portions may be curved.

The first and second side edge portions may be arcuate.

In an embodiment, each of said inclined first-side part of the bottom surface and said inclined second-side part of the bottom surface extend at least ten percent of the lateral width of the sports board.

In an embodiment, each of said inclined first-side part of the bottom surface and said inclined second-side part of the bottom surface extend at least twenty percent of the lateral width of the sports board.

In an embodiment the sports board is made primarily from a foam material.

In an embodiment the sports board is made primarily from a material which is buoyant in water.

The foam material may be an expanded polystyrene or expanded polypropylene foam.

The bottom surface may be formed from a material which is harder than the foam material.

The bottom surface may be formed from a material which has is a lower friction material than the foam material.

The bottom surface may be formed from a sheet of material adhered to a main body part of the sports board.

The bottom surface may be formed from a plastic.

The bottom surface may be formed from a high density plastic.

The bottom surface may be formed from polyethylene.

The bottom surface may be formed from high density polyethylene.

The sports board may have a board thickness of between 25 mm and 80 mm.

The sports board may have a board thickness of between 30 mm and 65 mm.

The sports board may have a board thickness of between 35 mm and 55 mm.

A sports board according to the first aspect may also be in accordance with the second, third and/or fourth aspects.

According to a second aspect, the present disclosure provides a sports board comprising:

a top surface for supporting a rider and a bottom surface;

a leading edge portion and a following edge portion with a central axis of the sports board extending between the leading edge and the following edge;

a first side edge portion and a second side edge portion located on respective first and second lateral sides of the central axis of the sports board, wherein:

a first-side part of the bottom surface is inclined upwardly towards the first edge portion, and a second-side part of the bottom surface is inclined upwardly, in a lateral direction, towards the second edge portion.

According to an embodiment of the second aspect, a more forward portion of the bottom surface is inclined upwardly towards the leading edge portion.

The bottom surface may further comprise a more rearward portion of the bottom surface which is inclined upwardly towards the following edge portion.

The bottom surface may further comprise a center region.

The center region may be substantially flat.

The center region may be convex.

One or more of said inclined bottom surface parts may be inclined upwardly from the center region towards a corresponding edge portion.

In an embodiment, each of said first-side part of the bottom surface and said second-side part of the bottom surface extend at least ten percent of the lateral width of the sports board.

In an embodiment, each of said first-side part of the bottom surface and said second-side part of the bottom surface extend at least twenty percent of the lateral width of the sports board.

A sports board according to the second aspect may also be in accordance with the first, third and/or fourth aspects.

According to a third aspect, the present disclosure provides a sports board comprising:

a top surface for supporting a rider and a bottom surface;

a leading edge portion and a following edge portion with a central axis of the sports board extending between the leading edge and the following edge;

a first side edge portion and a second side edge portion located on respective first and second lateral sides of the central axis of the sports board;

a plurality of attachment portions; and a towing arrangement comprising at least one elongate member, said towing arrangement being attachable to at least two of said attachment portions.

In an embodiment at least one attachment portion is provided on each lateral side of the central axis.

In an embodiment the towing arrangement is attachable to at least one attachment portion which is located on the first lateral side of the central axis and at least one attachment portion which is located on the second lateral side of the central axis In an embodiment according to the third aspect, the sports board further comprises a handle, and comprises at least three attachment portions, at least two of which are for attachment to said towing arrangement, and at least one of which is for attachment to the handle.

In an embodiment, the sports board comprises at least four attachment portions, at least two of which are for attachment to said towing arrangement, and at least two of which are for attachment to the handle.

In an embodiment, the sports board comprises at least two handles and at least six attachment portions, wherein:

at least two of said attachment portions are for attachment to said towing arrangement;

at least two others of said attachment portions are for attachment to a first handle; and, at least two others of said attachment portions are for attachment to a second handle.

In an embodiment, the attachment portions are located on the top surface.

In an embodiment each of the attachment portions is provided by an attachment structure which extends through the sports board.

Each attachment structure may extend through an aperture in the board.

Each attachment structure may comprise a head part, which is located on the top surface of the board and which is dimensioned to be unable to pass through the aperture, a tail part which is located on the bottom surface of the board and which is dimensioned to be unable to pass through the aperture, and a connection structure which extends through the aperture and connects the head part and the tail part.

Each attachment structure may comprise a first part which includes the head part and a first part of the connection structure, and a second part which includes the tail part and a second part of the connection structure, the first and second parts being connectable and disconnectable within the aperture to mutually couple or decouple the head and tail parts.

In an embodiment, the attachment portions are distributed symmetrically in relation to the central axis.

In an embodiment first and second attachment portions for attachment to the towing arrangement are provided symmetrically in relation to the central axis, spaced apart from the central axis, and are proximal to the leading edge portion.

Said first and second attachment portions for attachment to the towing arrangement may be spaced apart from the central axis.

Each of said first and second attachment portions for attachment to the towing arrangement may be spaced apart from the central axis by a lateral distance which is at least a quarter of the lateral width of the sports board.

Each of said attachment portions for attachment to a handle may be located adjacent to a side edge portion of the board.

Each of said attachment portions for attachment to a handle may be spaced apart from the central axis by a lateral distance which is at least a quarter of the lateral width of the sports board.

A sports board according to the third aspect may also be in accordance with the first, second and/or fourth aspects.

According to a fourth aspect, the present disclosure provides a sports board comprising:

a top surface for supporting a rider and a bottom surface;

a leading edge portion and a following edge portion with a central axis extending between the leading edge and the following edge;

a first side edge portion and a second side edge portion located on either lateral side of the central axis, a plurality of attachment portions located on the top surface to which at least two handles and at least towing arrangement may be attached, the towing arrangement being attachable to at least two spaced apart attachment portions; wherein at least a portion of the bottom surface is inclined upwardly in a lateral direction away from the central axis towards each of the first and second side edges; and wherein the lateral width of the sports board, between the first side edge portion and the second side edge portion is equal to, or greater than, the distance between the leading edge and the following edge.

In an embodiment according to the fourth aspect, the the leading edge and the following edge are substantially straight edges.

It will be appreciated that a feature described in relation to one aspect may be beneficially incorporated in any one or more of the other aspects of the invention.

BRIEF DESCRIPTION OF THE DRAWINGS

Embodiments will now be described, by way of example only, with reference to the accompanying drawings in which:

FIG. 10 is a schematic cross sectional view of a part of the sports board of FIGS. 1 to 9, showing a connection portion which connects a handle to the rest of the sports board;

DETAILED DESCRIPTION

Figure 1:
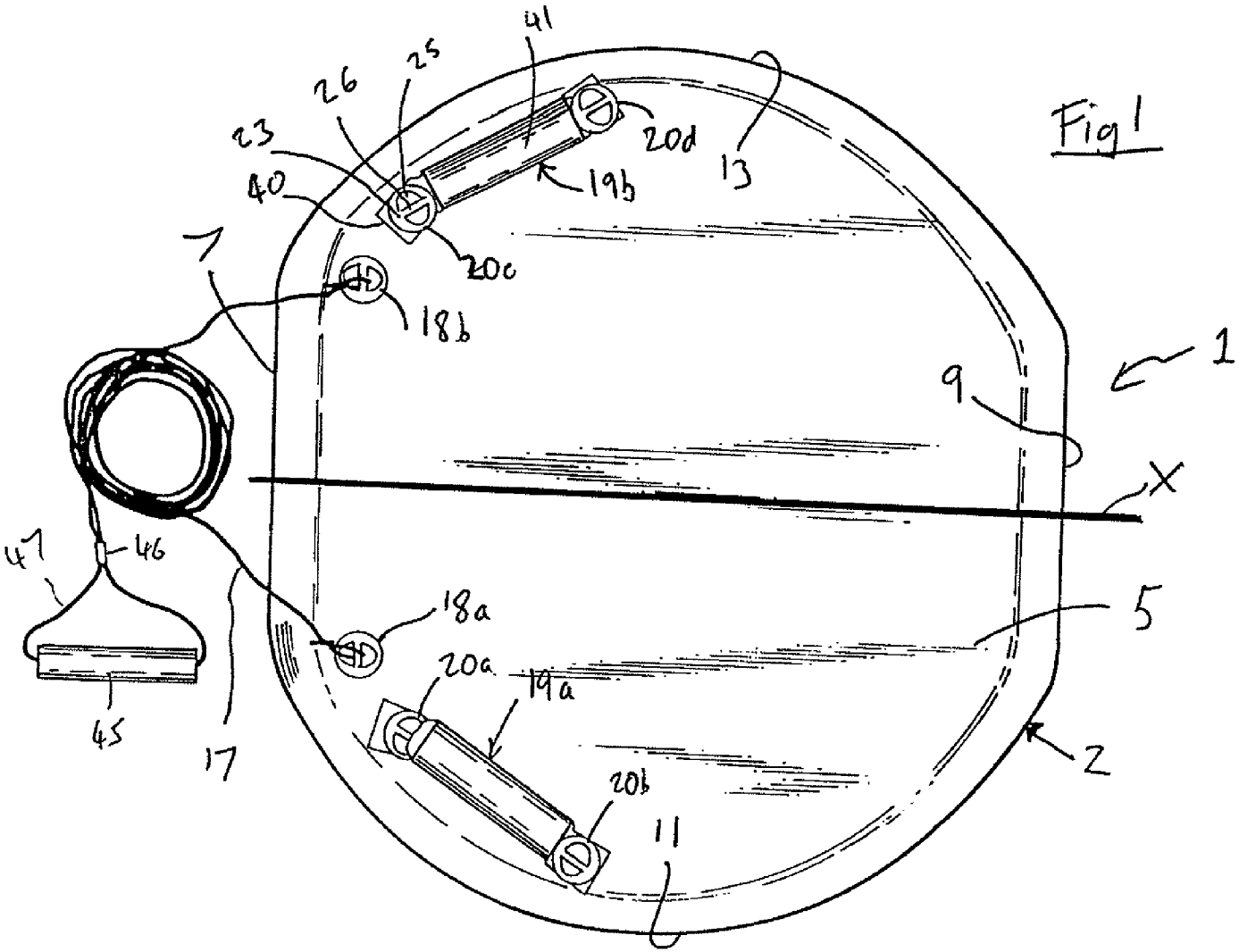
FIG. 1 is a plan view from above of an embodiment of a sports board in accordance with the present disclosure.
Figure 2:
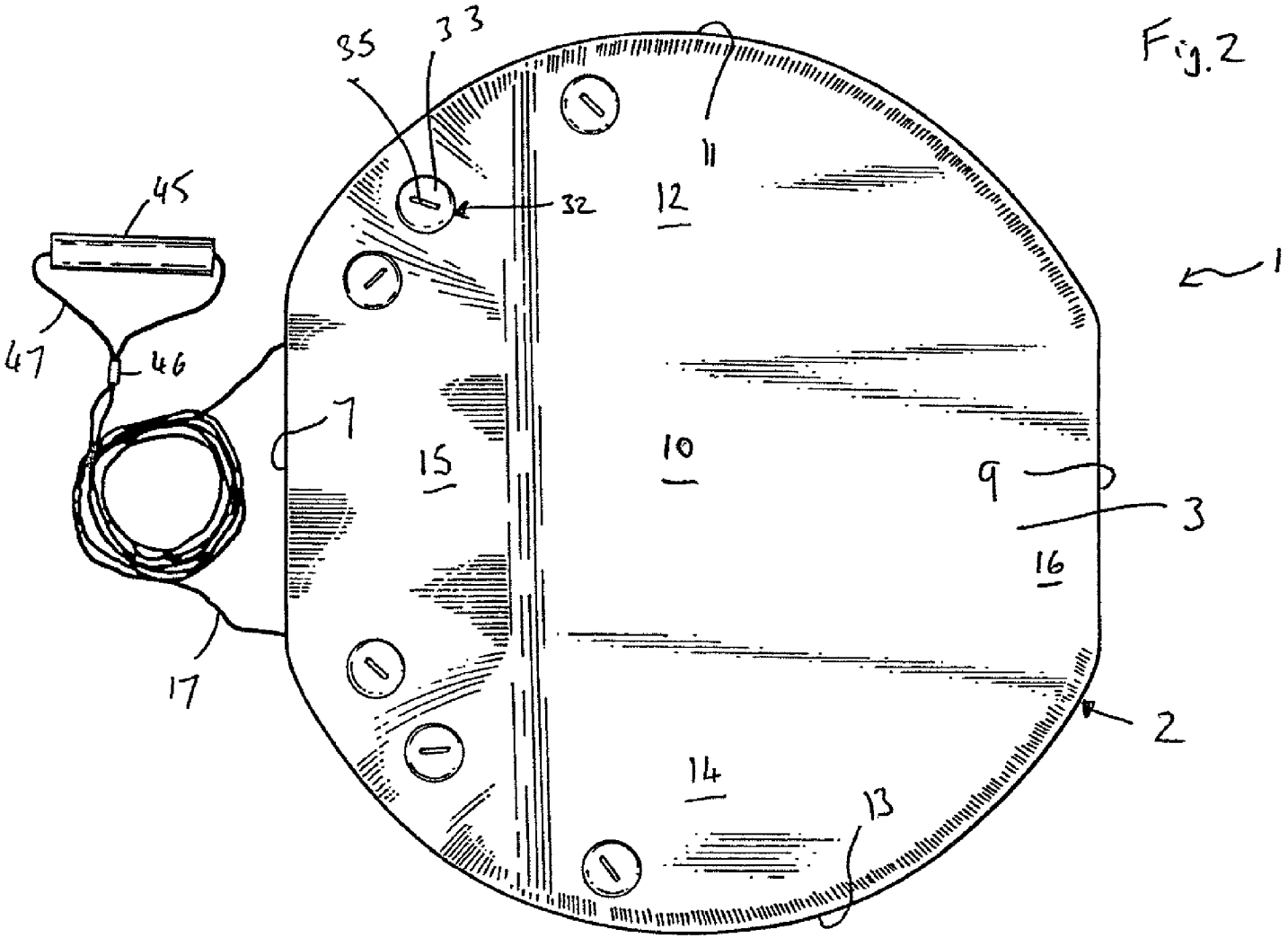
FIG. 2 is a bottom view of the sports board of FIG. 1.
Figure 3:
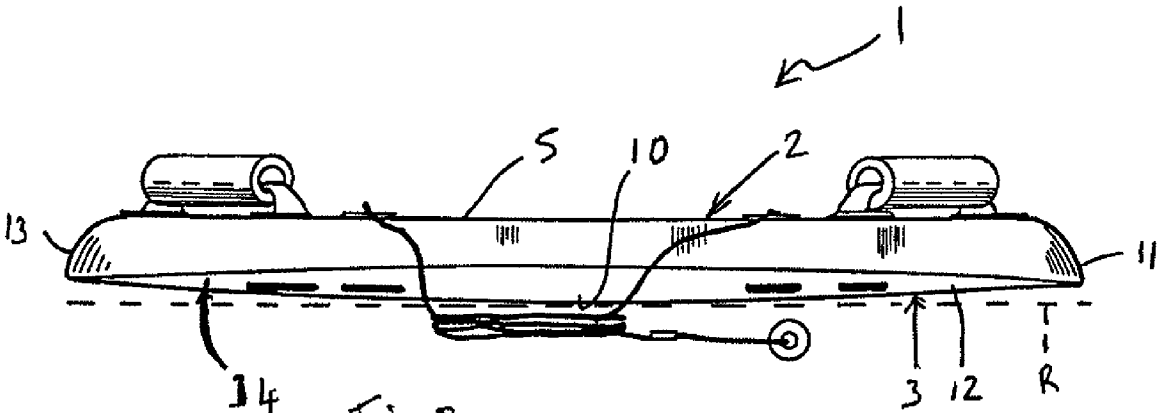
FIGS. 3 and 4 are, respectively, front and rear views of the sports board of FIGS. 1 and 2.
Figure 4:
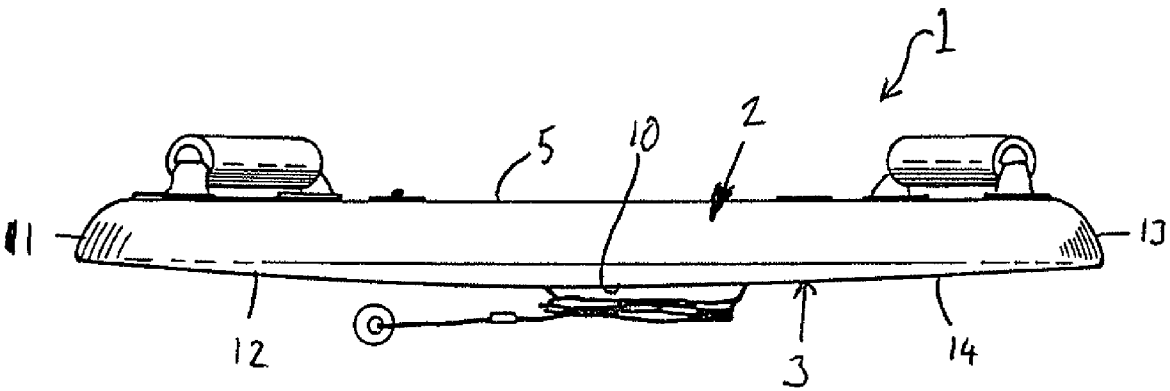
Figure 5:
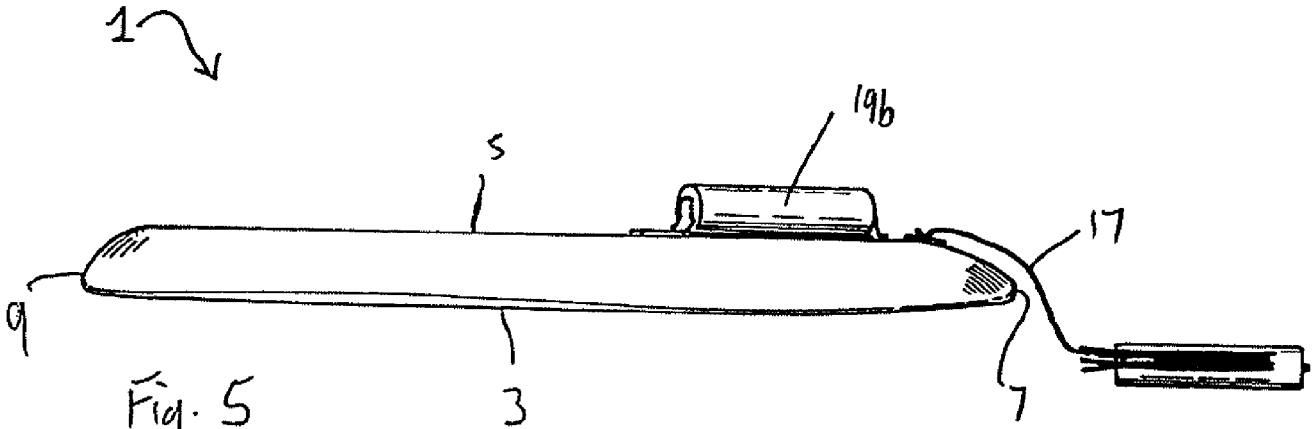
FIGS. 5 and 6 are, respectively, first and second side views of the sports board of FIGS. 1 to 4.
Figure 6:
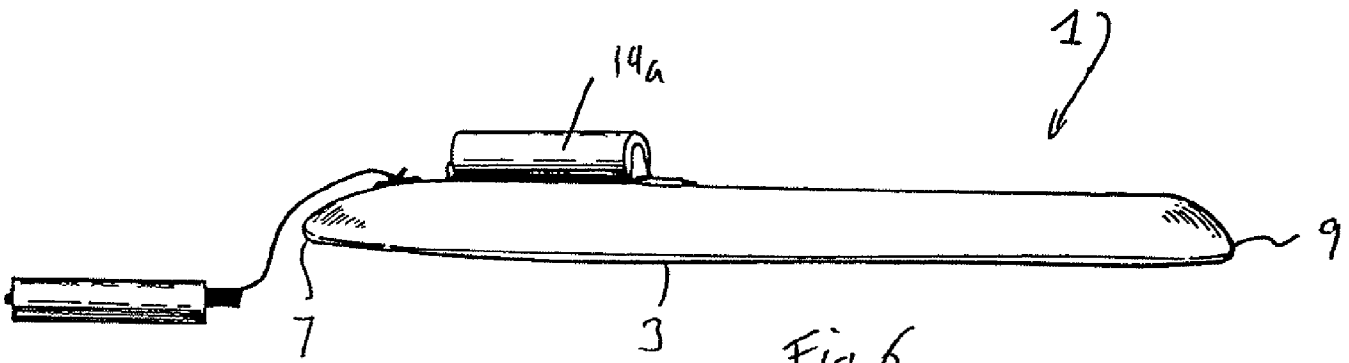
Figure 7:
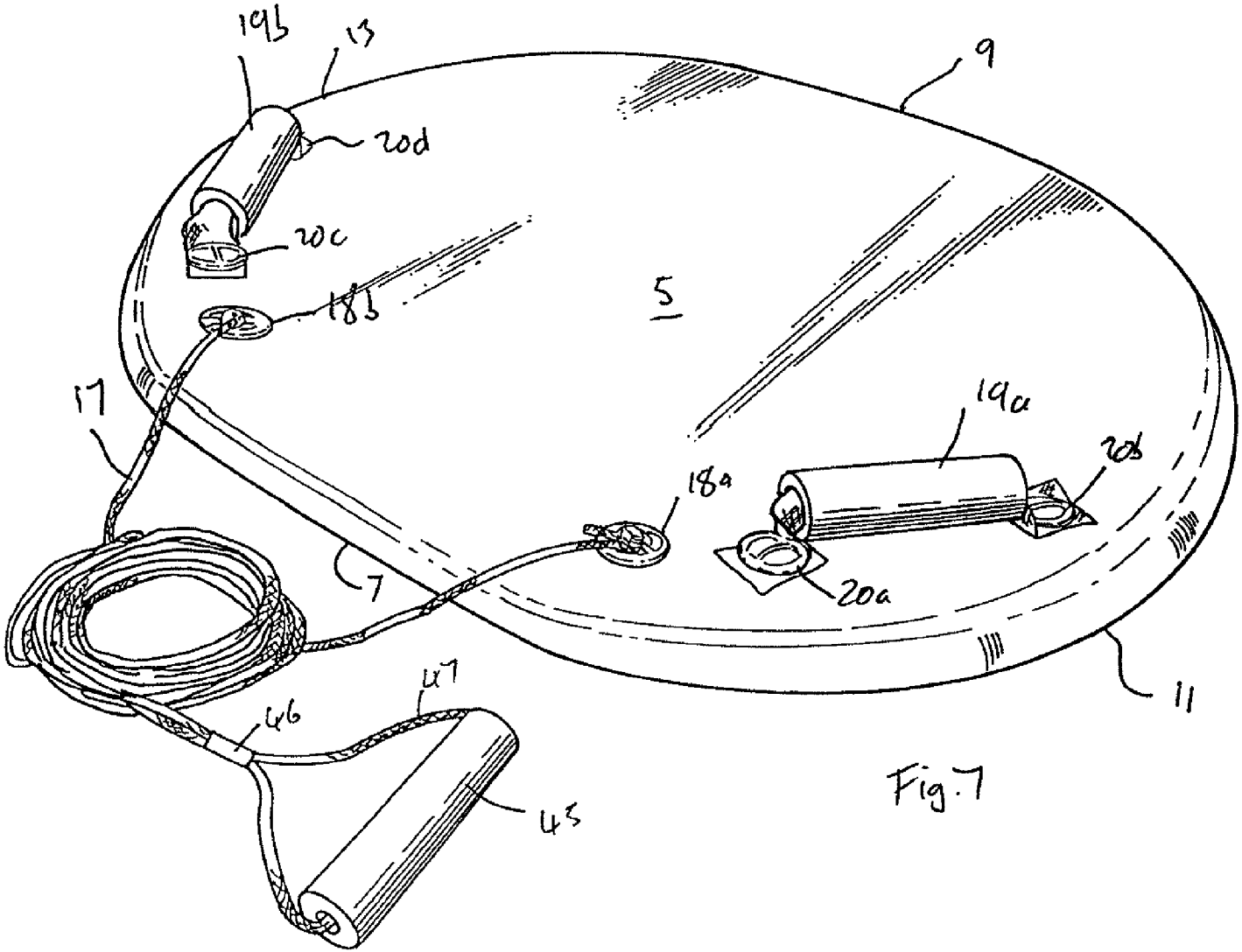
FIGS. 7 and 8 are, respectively, top and bottom perspective views of the sports board of FIGS. 1 to 6.
Figure 8:
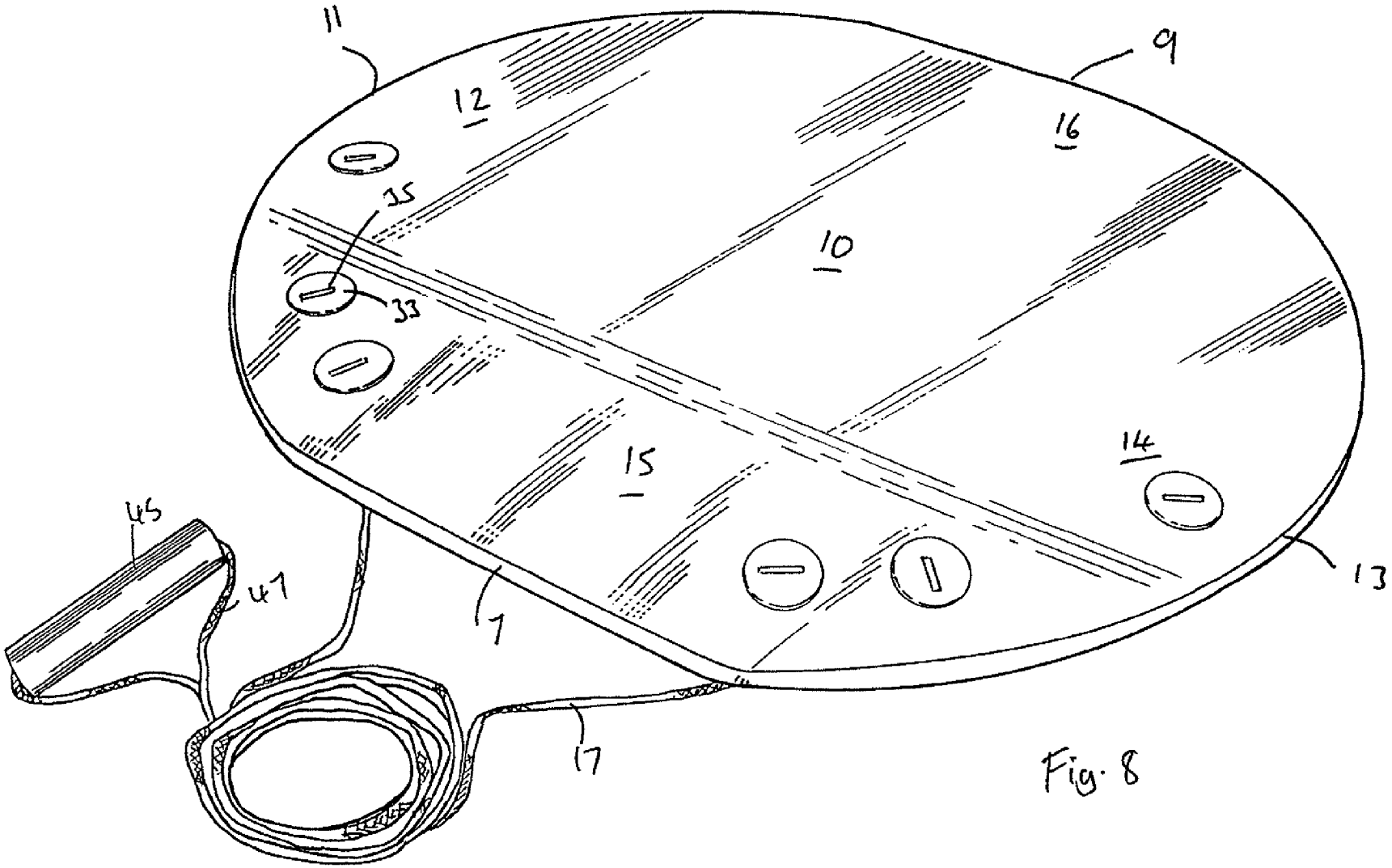
Figure 9:
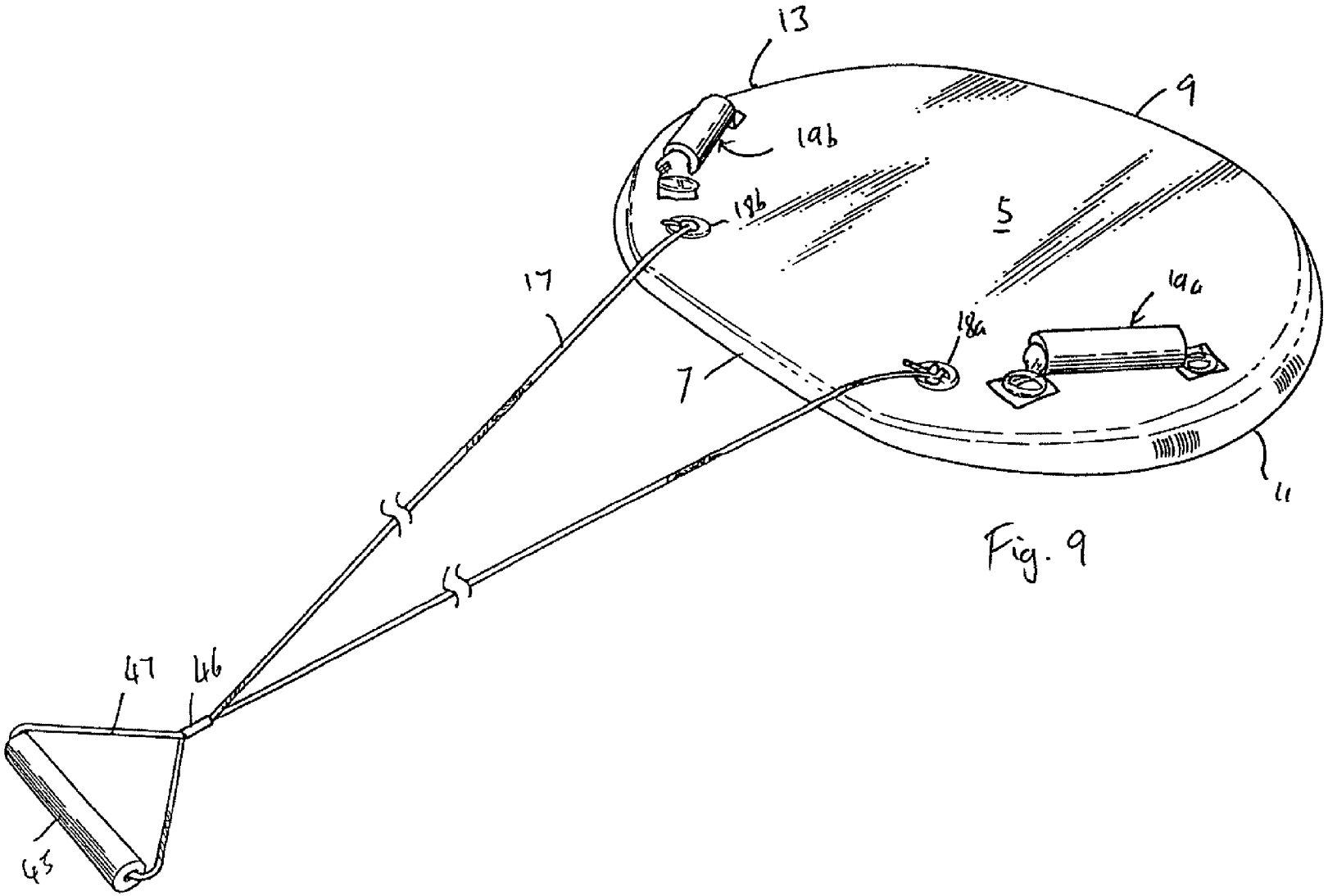
FIG. 9 is a top perspective view of the sports board of FIGS. 1 to 8 with a towing arrangement, in the form of a tow rope, in a different arrangement.
Figure 1D:
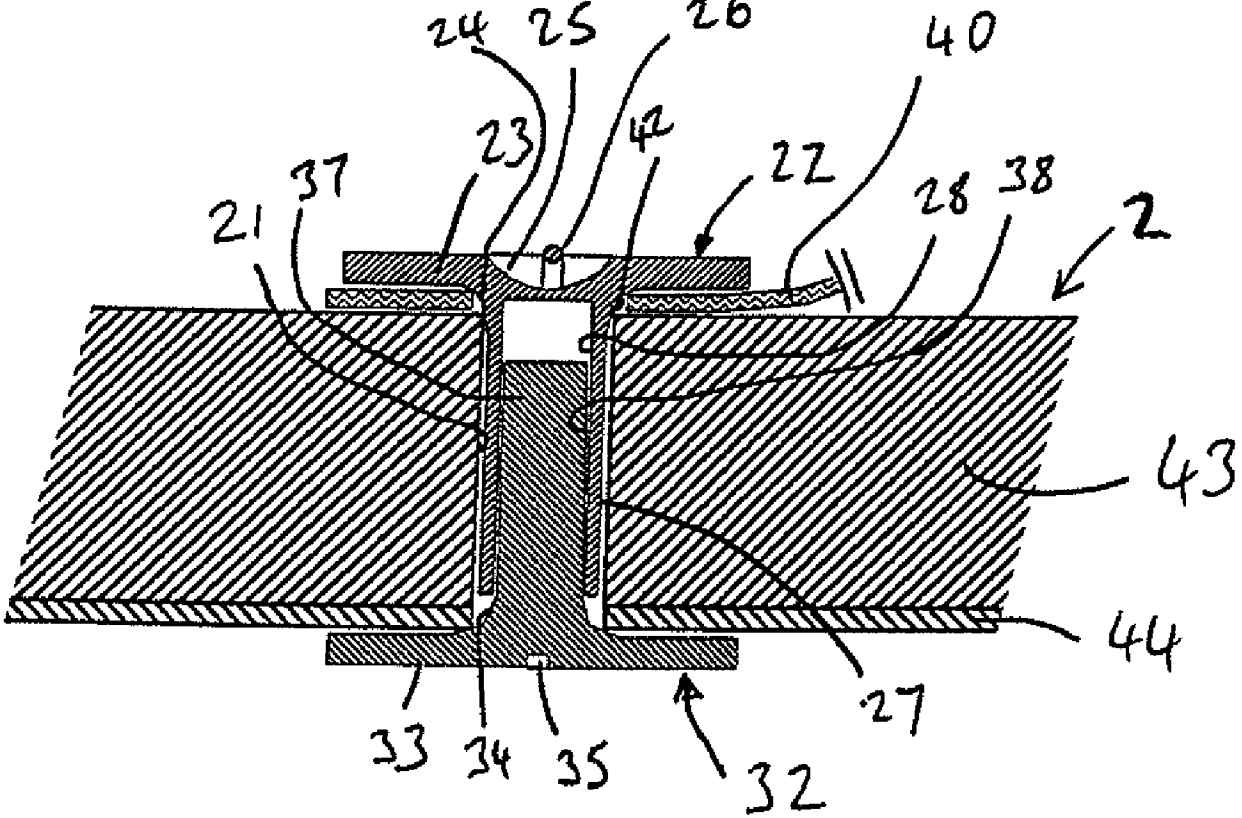

With reference to FIGS. 1 to 10, an embodiment of a sports board, generally designated 1, comprises a boardlike body 2 with a bottom surface 3 and a top surface 5. The structure and composition of the boardlike body 2 has similarities with the structure and composition of some known bodyboards, but is shaped and dimensioned differently, as will be appreciated from the following description. In this embodiment, sports board 1 has a maximum board thickness of approximately 44 mm.

The body 2 has a substantially straight leading edge 7 and a substantially straight following edge 9. The body 2 has first and second curved, generally arcuate, side edges 11, 13 which meet the leading edge 7 and the following edge 9 to define a perimeter of the sports board, and which provide a maximum width of the board approximately mid-way between the leading edge 7 and the following edge 9.

The body 2 has a width (between the most distant laterally opposed parts of the side edges) which is approximately the same as, or slightly greater than, the length (ie the distance between the leading edge 7 and the following edge 9). In this embodiment, the body 2 has a width of 700 mm and a length of 640 mm. It will be appreciated that the dimensions of other embodiments may be different. It will also be appreciated that in some alternative embodiments, such as the embodiment of FIGS. 11 and 12, the body is substantially circular in shape, so the length and the width are substantially identical (and equal to the diameter of the circular body).

The bottom surface 3 has a center region 10. The bottom surface 3 slopes upwardly from the center region 10 of the sports board towards the first and second side edges 11, 13. Thus, between the center region 10 and the first side edge 11, there is provided a sloping first side part 12 of the bottom surface, and between the center region 10 and the second side edge 13, there is provided a sloping second side part 14 of the bottom surface. In the illustrated embodiment the center region 10 is somewhat convex, so that the lateral center of the bottom surface is the lowest part of the bottom surface 3. This can be seen in, for example FIG. 3, in which the distances between a horizontal reference line R and various laterally spaced apart points on the bottom surface 3 can be observed. Parts of the bottom surface which are laterally further from the lateral center of the bottom surface are spaced further from the horizontal reference line R. In an alternative embodiment the center region of the bottom surface may be a substantially flat or planar region, but sloping first and second side parts of the bottom surface, which slope upwardly from the central region to the respective first and second side edges, may still be provided.

Further, the bottom surface 3 also includes a more forward portion 15 which slopes upwardly from the center region towards the leading edge 7 and may include a more rearward portion 16 which slopes upwardly from the center region towards the following edge 9.

Further, the bottom surface 3 also includes a more forward portion 15 which slopes upwardly from the centre region towards the leading edge 7 and may include a more rearward portion 16 which slopes upwardly from the centre region towards the following edge 9.

The sports board 1 further comprises a towing arrangement comprising at least one elongate member which in this embodiment is in the form of a tow rope 17. The sports board further comprises first and second laterally spaced apart rope attachment portions 18*a*, 18*b* located on the top surface 5 (see especially FIGS. 1, 3, 4, 7 and 9) for allowing the tow rope 17 to be attached to the body 2 at two laterally spaced apart points.

The sports board 1 further comprises first and second handles 19*a*, 19*b*, and first to fourth handle attachment portions 20*a*, 20*b*, 20*c*, 20*d* for allowing the handles 19*a*, 19*b* to be attached to the body 2. A rider may hold onto the handles to assist in staying on the sports board, for example while the sports board is towed over water.

With particular reference to FIG. 10, in an embodiment, each attachment portion 18*a*, 18*b*, 20*a*, 20*b*, 20*c*, 20*d* comprises connectable upper and lower attachment parts 22, 32. For convenience only one attachment portion will be described in detail, but it should be appreciated that each of the attachment portions 18*a*, 18*b*, 20*a*, 20*b*, 20*c*, 20*d* may be substantially identical. The (or each) attachment portion is adapted to extend through a vertical aperture 21 provided in the body 2. The (or each) upper attachment part 22 comprises a head part in the form of an upper flange portion 23 and part of a connection structure in the form of an upper stem portion 27, which depends downwardly from a central region of an underside of the flange portion 23 and in use extends into the aperture 21. The upper flange portion 23 is dimensioned to be unable to pass into the aperture 21, but is provided with a tapered part 24 on its underside, where it is connected to the stem portion 27, to assist secure and snug location in the aperture 21. The upper flange portion 23 is provided with a dished recess 25 in the upper surface thereof, and a connection element 26 which extends across the top of the dished recess 25, so that a rope or chord can be tied onto the connection element 26 in order to be secured to the attachment portion.

The upper stem portion 27 comprises means to attach to the lower attachment part 32, which in this embodiment is in the form of a female threaded part 28.

The (or each) lower attachment part 32 comprises a tail part in the form of a lower flange portion 33 and part of a connection structure in the form of a lower stem portion 37, which depends upwardly from a central region of an upper side of the lower flange portion 33 and in use extends into the aperture 21. The lower flange portion 33 is dimensioned to be unable to pass into the aperture 21, but is provided with a tapered part 34 on its upper side, where it is connected to the lower stem portion 37, to assist secure and snug location in the aperture 21. The lower flange portion 33 is provided with a groove 35 in the lower surface thereof, which is adapted to receive a tool, such as a screwdriver bit or a coin, to assist in tightening (or loosening) the connection between the upper and lower attachment parts 22, 32. The lower stem portion 37 comprises means to attach to the upper attachment portion 22, which in this embodiment is in the form of a male threaded part 38 adapted to connect to the female threaded part 28 of the upper stem portion 27.

To secure an attachment portion to the sports board body, the upper stem portion 27 is inserted into the aperture 21 from above the body 2 and the lower stem portion is inserted into the aperture 21 from below the body 2. The threaded parts 28, 38 are then rotated relative to each other to securely connect the upper and lower attachment parts 22, 32 together, and thus to secure the attachment portion to the body 2. It will be appreciated that many variations are possible and that, for example, means of connection other than threaded connection (for example a snap-fit connection) could be used if desired.

As foreshadowed above, a towing arrangement, such as tow rope 17 can be attached to an attachment portion, in this embodiment by attachment, such as tying on, to connection element 26. In the illustrated embodiment the connection element 26 is in the form of a small bar or member which extends across the dished recess 25, but it will be appreciated that in alternative embodiments other structures for attaching the towing arrangement to the attachment portions may be used.

In the illustrated embodiment each handle comprises a length of webbing 40 (such as nylon webbing) which may, for comfort, be provided with padding, in this embodiment in the form of a tubular foam element 41 (although other padding or comfort enhancing covering could be used). As illustrated for example in FIG. 10, the webbing 40 may be attached to the body 2 passing the upper stem portion 27 of the upper attachment part 22 through an aperture 42 in the webbing before the upper stem portion is inserted into the aperture 21 from above the body 2. When the upper and lower attachment parts 22, 32 are secured together the webbing 40 will be secured and retained between the upper flange portion 23 and the body.

As illustrated in FIG. 10, the body 2 may comprise a main body part 43, which constitutes most of the thickness of the body, made from a buoyant foam material such as (but not limited to) an expanded polystyrene or expanded polypropylene foam, and a thin sheet of higher density, more robust, material 44 (such as, but not limited to a plastic such as high density polyethylene) attached to the bottom of the main body part to provide the bottom surface. It is desirable that the more robust material is a low friction material compared to the foam material.

In use, a rider may sit, kneel or lie on the sports board whilst the sports board is pulled or towed by another person. A primary anticipated use is for a child to ride on the sports board while being towed by an adult in shallow water. However, other uses are possible, for example the sports board 1 may be used for body boarding in a similar manner to a conventional body board, or may be used as a toboggan, especially a sand toboggan.

As may be seen from, for example FIG. 1, handle attachment portions 20*a*, 20*b*, 20*c*, 20*d*, are located adjacent first and second side edges 11, 13, proximal to leading edge 7 and spaced in a symmetrical distribution relative to, and on either side of, a central axis X, which is effectively an axis of symmetry of the sports board extending between leading edge 7 and following edge 9. The consequent positioning of handles 19*a*, 19*b*, towards the front and sides of the sports board 1 helps provides stability and control for the rider of the sports board as it is towed along, for example, in shallow water.

Attachment portions 18*a*, 18*b* to which a towing arrangement, such as one or more ropes (or other suitable elongate flexible members) may be attached, are also located adjacent first and second side edges 11, 13, proximal to leading edge 7 and spaced symmetrically and on either side of the central axis X extending between leading edge 7 and following edge 9. This arrangement (compared, for example, to provision of a single laterally central point of attachment for the tow rope 17) can assist is providing lateral stability during towing of the sports board, and can also provide enhanced lateral control of the sports board by the person towing it. In the illustrated embodiment the towing arrangement comprises the tow rope 17, which is attached at its first and second ends to attachment portions 18*a*, 18*b* to provide a loop. Grip or comfort may be improved by providing a towing arrangement handle on the towing arrangement, which in this embodiment is in the form of a tubular handle part 45 (although other forms of towing arrangement handle could be used). Parts of the elongate element (or towing rope) may be connected by a suitable connector 46 so that the handle is provided in a sub-loop 47 of the towing arrangement. In the illustrated embodiment the connector is provided close to the handle.

Alternative forms of towing arrangement are possible: for example, a towing arrangement comprising two separate elongate flexible elements (eg tow ropes) connected to respective laterally spaced apart attachment portions of the board could be used, and could provide a person towing the board with a still greater degree of control over the board's movement.

Without wishing any exposition of theory to be limiting, it is believed that the upward slope of the bottom surface 3, and in particular the upward slope of the bottom surface from the center region 10 towards the side edges 11, 13, allows the sports board to more easily glide or "aquaplane" on a water surface, in use. During towing, resistive pressure of water against the moving inclined or sloping parts of the bottom surface 3 will provide an upwards force component acting upon the bottom surface, which may provide a degree of lift and assist gliding or skimming on the water.

Providing a board which is relatively short in length (compared to conventional body boards) helps avoid the following end of the board digging into sand below shallow water if the front of the board is lifted slightly (for example, by the person towing the board or by the rider leaning rearwards and/or pulling up on the handles).

Providing a board which is relatively wide in width is believed to provide increased lateral stability as the sports board is pulled or towed across, for example, a water surface, reducing the likelihood of the board 'rolling' sideways during use.

Thus providing a sports board in which the width is equal to or greater than the length (in contrast to typical surf or body boards which have a length considerable greater than their width) can be advantageous. Further, the upward slope of the bottom surface 3 towards at least the first and second side edges, is believed beneficial as it promotes skimming or aquaplaning (as against undesirable rolling) as the sports board is pulled or towed (for example across a water surface) with a velocity component in the lateral direction of the sports board. In use, a person towing the sports board is likely to wish to move the sports board in a curved path, and may even wish to stand still and move the sports board in a generally circular path about himself or herself. Under these circumstances a significant component of the velocity will be in the lateral direction of the sports board.

Figure 11:
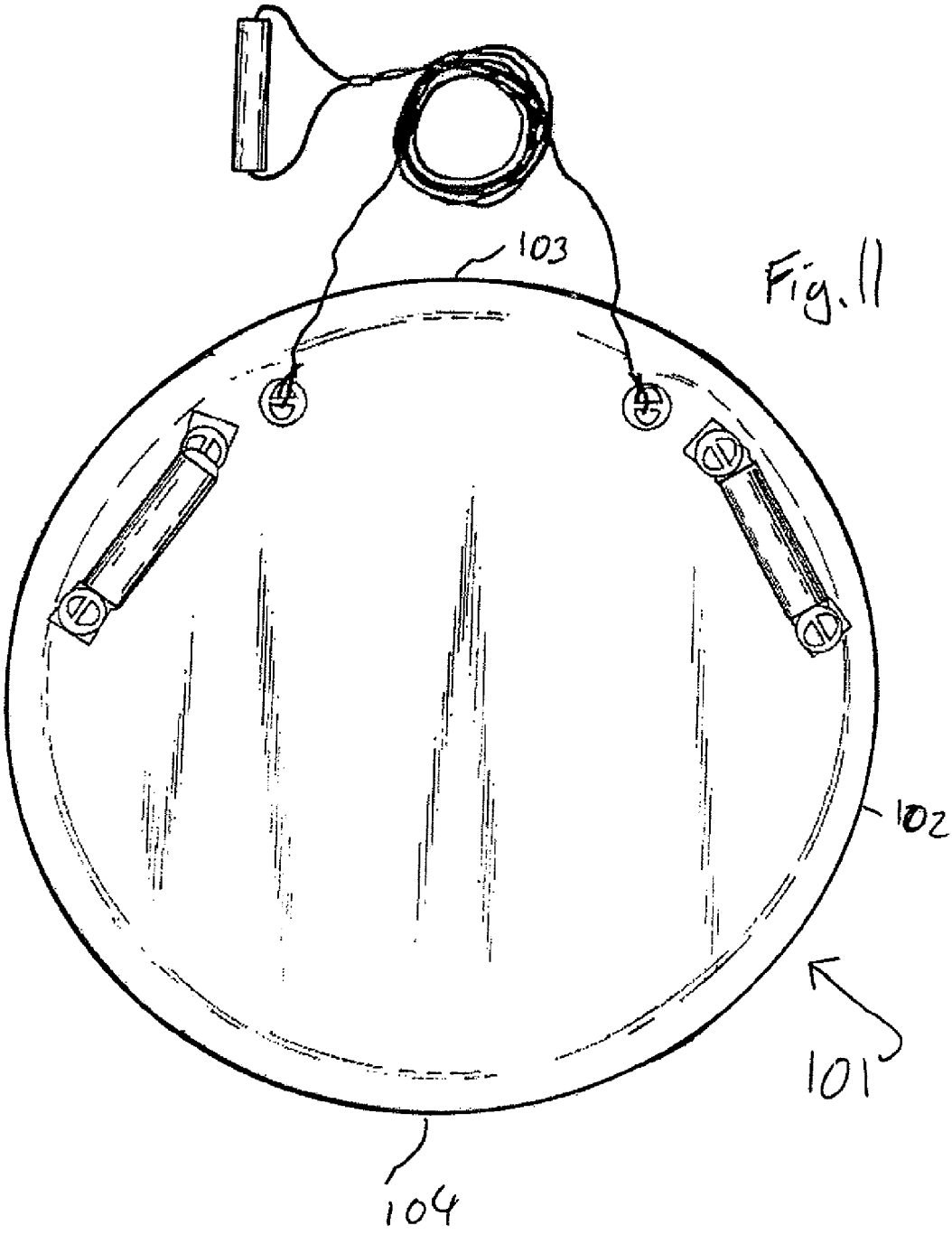
FIGS. 11 and 12 are, respectively top plan and bottom views of another embodiment, in which a sports board is generally circular in shape.
Figure 12:
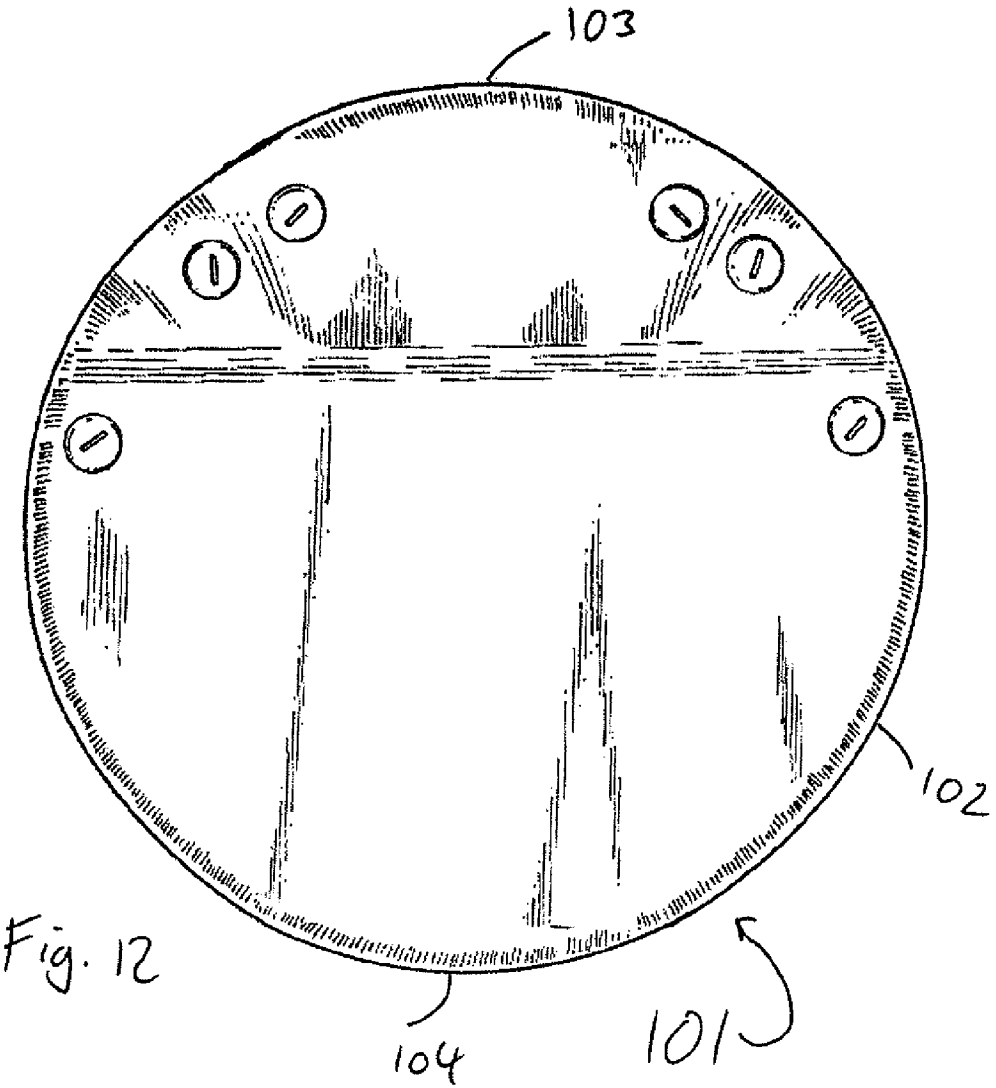
Figure 13:
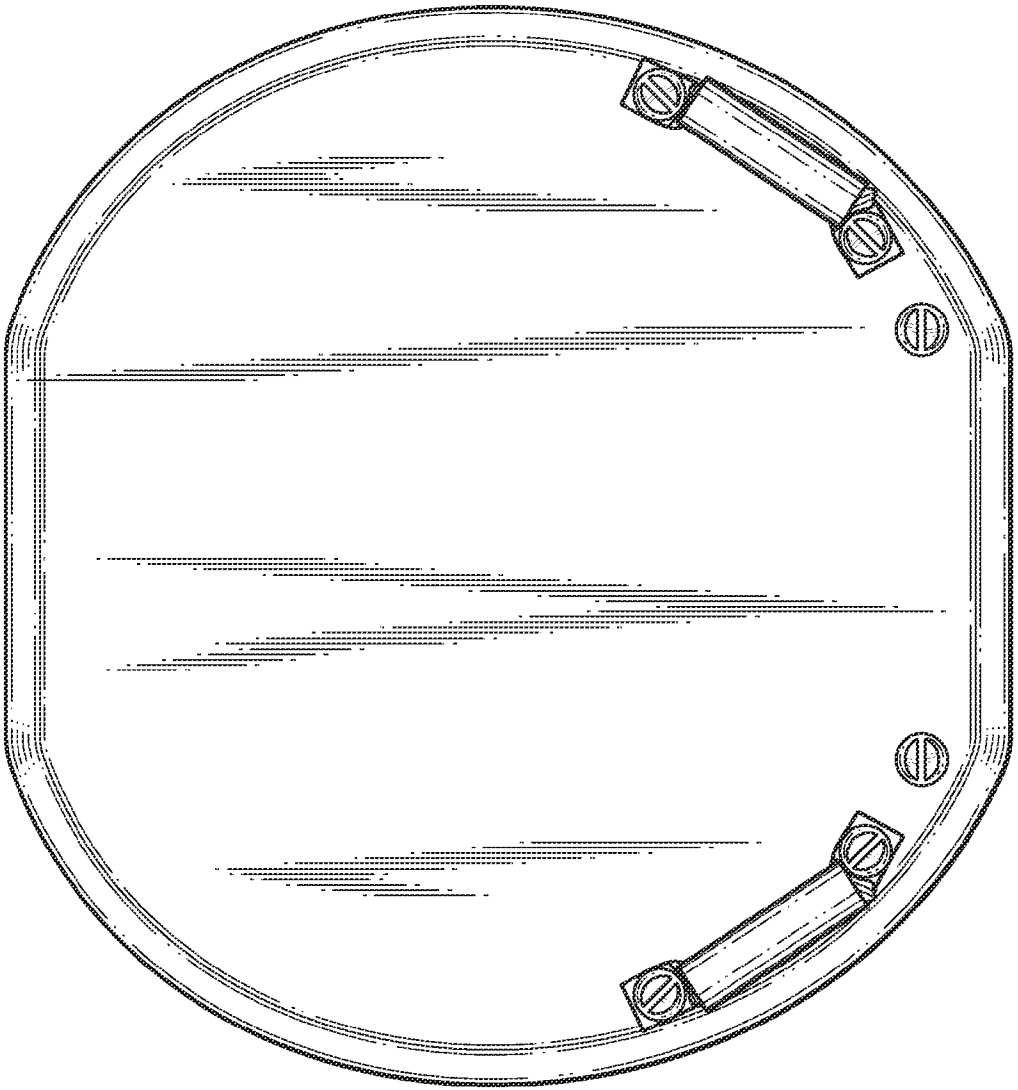
FIGS. 13 through 21 show an additional embodiment of a sports board in accordance with the present disclosure.
Figure 14:
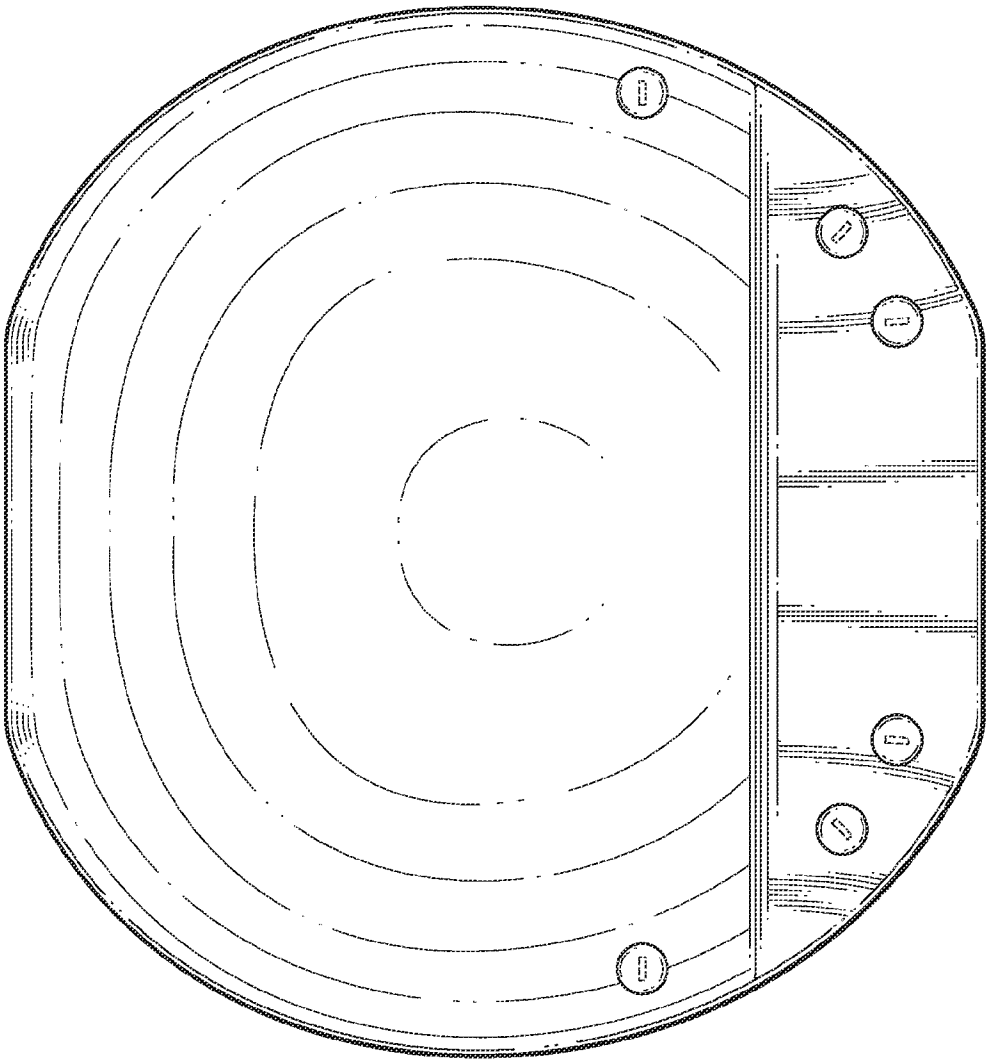
Figure 15:
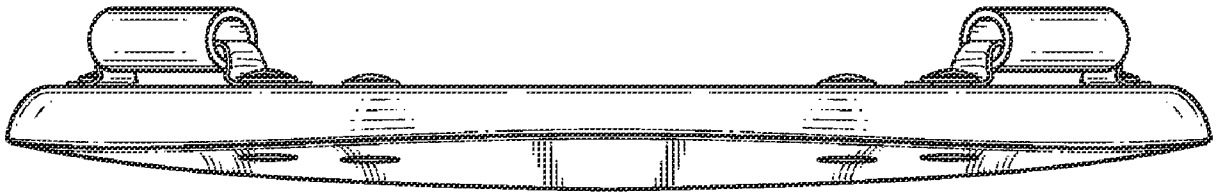
Figure 16:
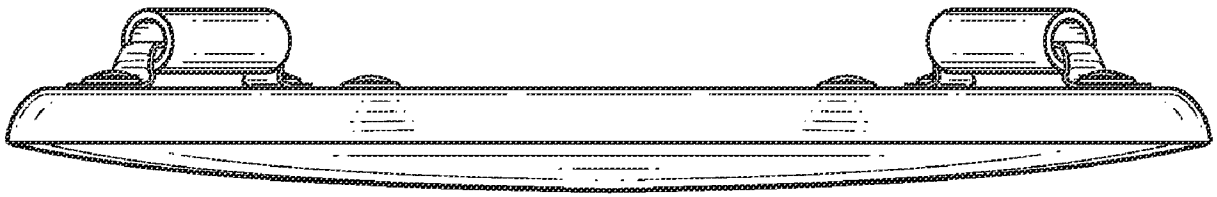
Figure 17:
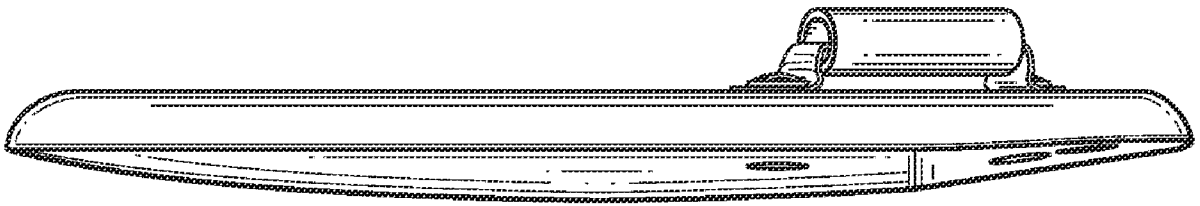
Figure 18:
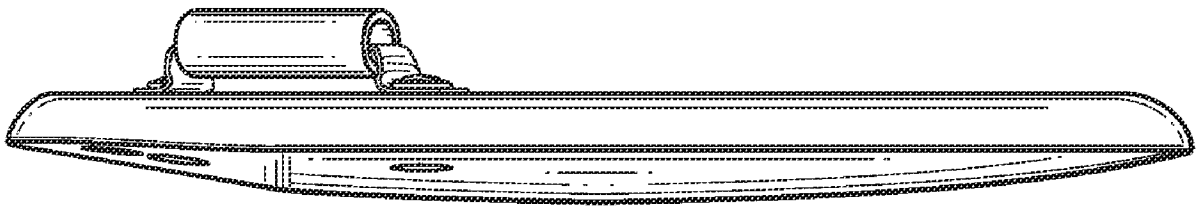
Figure 19:
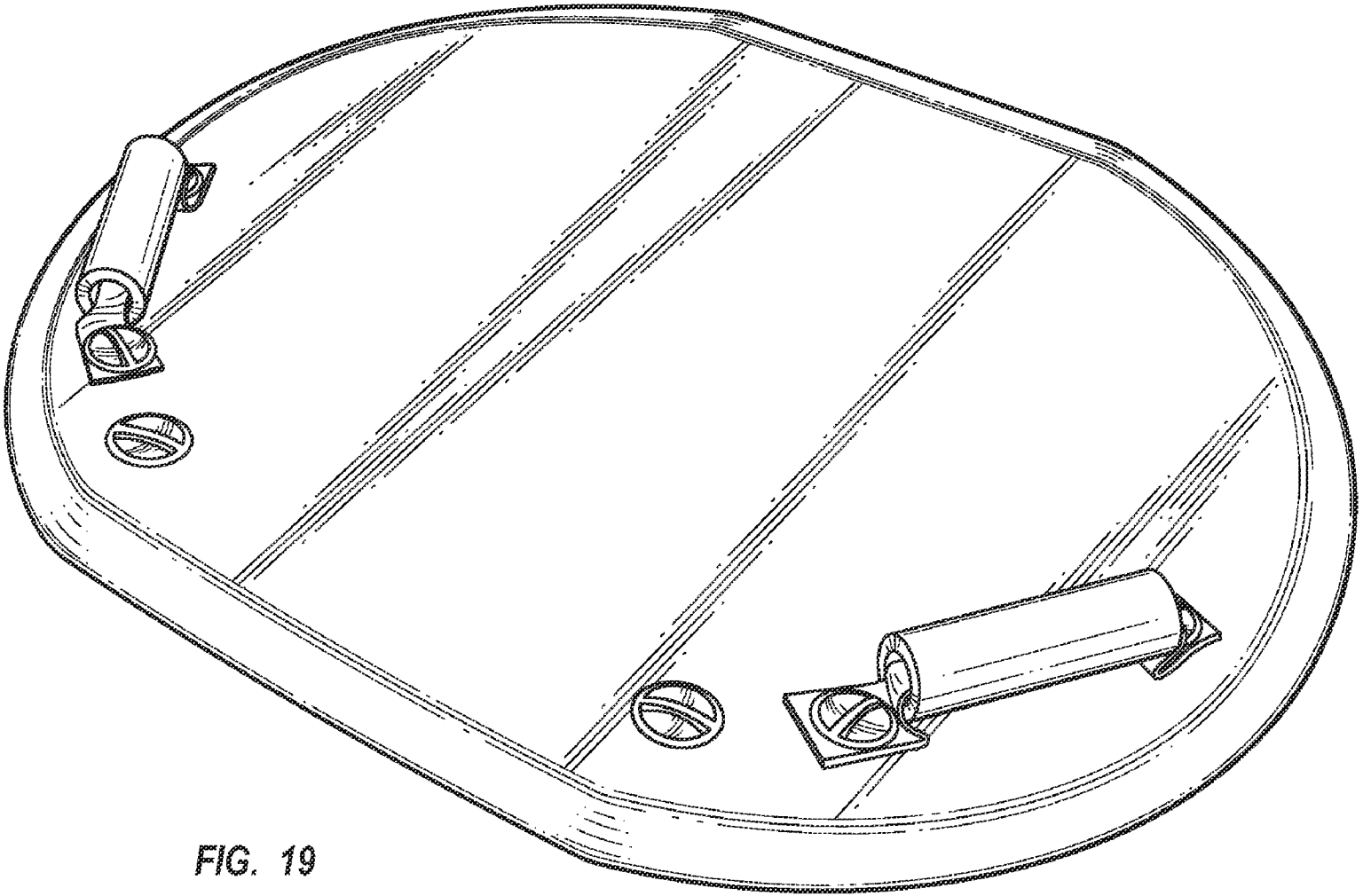
Figure 20:
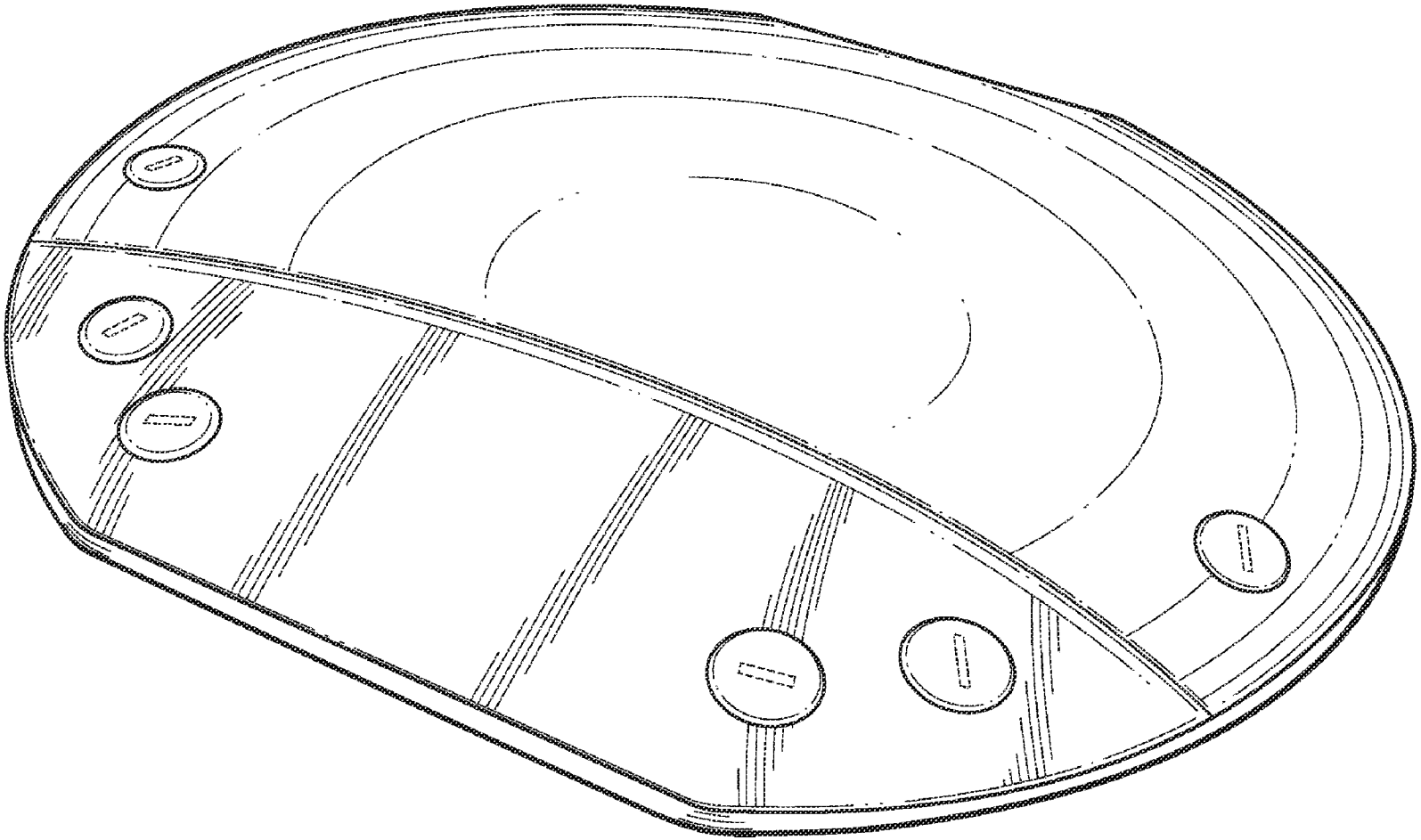
Figure 21:
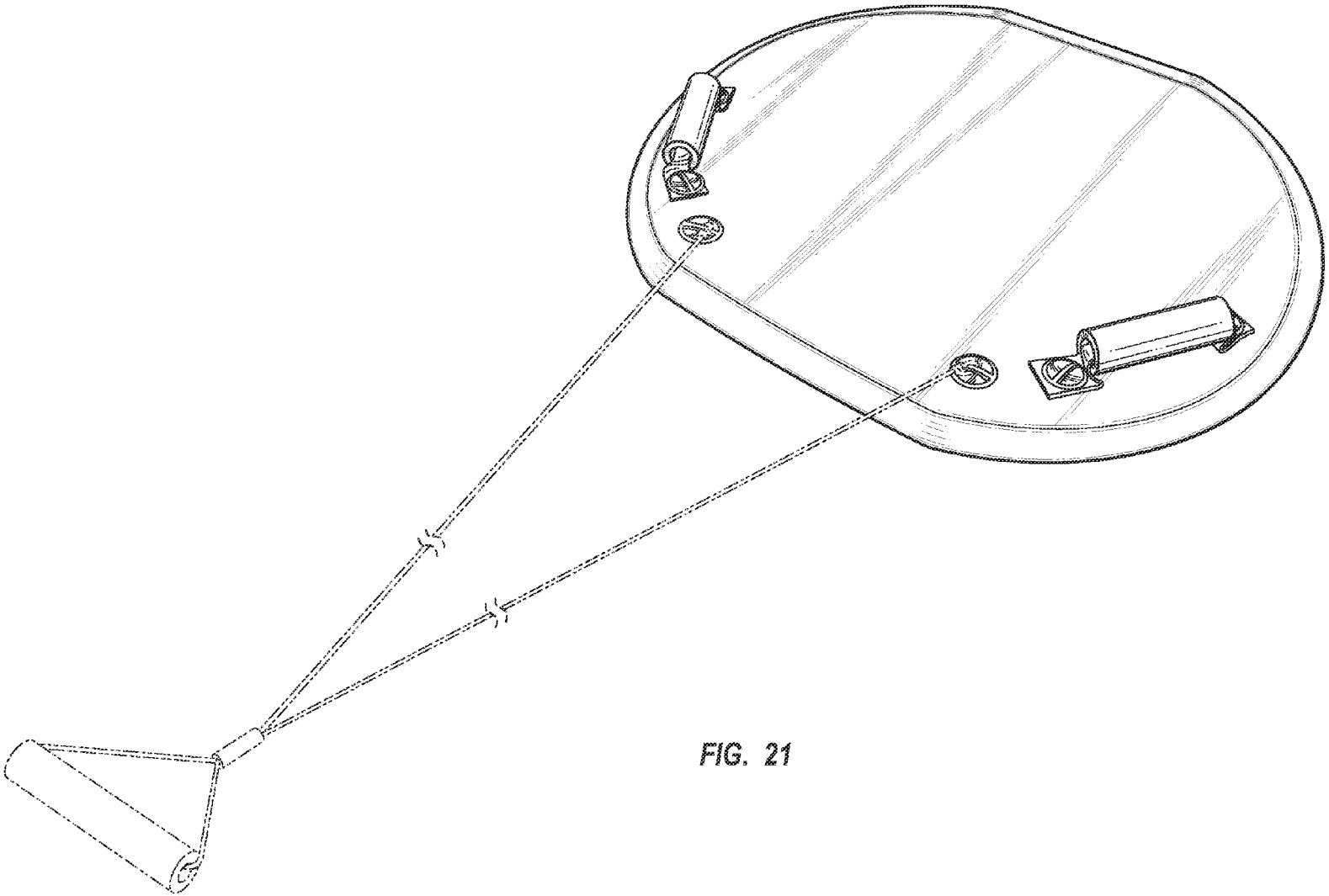

It will be appreciated that many variations are possible without departing from the scope of the present disclosure. For example, as illustrated in FIGS. 11 and 12, an alternative embodiment of a sports board, generally designated 101, is generally circular, having a generally circular continuous periphery 102. It will be appreciated that in most other respects the sports board 101 may be similar to sports board 1. Although the sports board 101 would share many operating characteristics of sports board 1, it is considered that providing a generally straight front edge is beneficial, as (compared to arcuate front edge 103 of sports board 101) it may reduce the likelihood of the front edge 'digging in' during use (especially during use as a sand toboggan on uneven sand). Similarly, providing a generally straight rear, or following, edge is currently considered beneficial, as (compared to arcuate following edge 104 of sports board 101) it may reduce the likelihood of the following edge 'digging in' to sand below shallow water if the front of the board is lifted slightly (for example, by the person towing the board or by the rider leaning rearwards and/or pulling up on the handles).

It will be appreciated that the sports board may be made of any suitable material, preferably a material capable of maintaining buoyancy on a water surface, for example, foam, polymer or wood.

In a preferred embodiment, the sports board has an expanded polystyrene or expanded polypropylene foam core body and is coated on the bottom surface with high density polyethylene (HDPE).

It will be understood to persons skilled in the art of the invention that many modifications may be made without departing from the spirit and scope of the invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Variations and modifications can be made in respect of the disclosure above and defined in the following claims.

The invention claimed is:

1. A sports board comprising:

a top surface for supporting a rider and a bottom surface;

a leading edge portion and a following edge portion with a central axis of the sports board extending between the leading edge portion and the following edge portion;

a first-side edge portion and a second-side edge portion located on respective first and second lateral sides of the central axis of the sports board;

a plurality of attachment portions; and a towing arrangement comprising at least one elongate member, said towing arrangement being attachable to at least two of said attachment portions; and wherein a first-side part of the bottom surface is inclined upwardly towards the first-side edge portion, and a second-side part of the bottom surface is inclined upwardly in a lateral direction, towards the second-side edge portion and wherein a maximum lateral width of the sports board between distal parts of the first-side edge portion and the second-side edge portion is equal to, or greater than, the distance between the leading edge portion and the following edge portion.

2. A sports board according to claim 1 wherein at least one attachment portion is provided on each lateral side of the central axis and the towing arrangement is attachable to at least one attachment portion which is located on the first lateral side of the central axis and at least one attachment portion which is located on the second lateral side of the central axis.

3. A sports board according to claim 2 wherein the sports board further comprises a handle, and comprises at least three attachment portions, at least two of which are for attachment to said towing arrangement, and at least one of which is for attachment to the handle.

4. A sports board according to claim 3 wherein the sports board comprises at least four attachment portions, at least two of which are for attachment to said towing arrangement, and at least two of which are for attachment to the handle.

5. A sports board according to claim 4 wherein the sports board comprises at least two handles and at least six attachment portions, wherein:

at least two of said attachment portions are for attachment to said towing arrangement;

at least two others of said attachment portions are for attachment to a first handle; and, at least two others of said attachment portions are for attachment to a second handle.

6. A sports board according to claim 5 wherein attachment portions are located adjacent to each of the first and second side edge portions and proximal to the leading edge portion.

7. A sports board according to claim 1 wherein each of the attachment portions is provided by an attachment structure which extends through an aperture in the sports board.

8. A sports board according to claim 7 wherein each attachment structure comprises a head part, which is located on the top surface of the board and which is dimensioned to be unable to pass through the aperture, a tail part which is located on the bottom surface of the board and which is dimensioned to be unable to pass through the aperture, and a connection structure which extends through the aperture and connects the head part and the tail part.

9. A sports board according to claim 2 wherein first and second attachment portions for attachment to the towing arrangement are provided symmetrically in relation to the central axis, spaced apart from the central axis, and are proximal to the leading edge portion.

10. A sports board according claim 9 wherein each of said first and second attachment portions for attachment to the towing arrangement are spaced apart from the central axis by a lateral distance which is at least a quarter of a lateral width of the sports board.

11. A sports board according to claim 6 wherein each of the attachment portions is provided by an attachment structure which extends through an aperture in the sports board.

12. A sports board according to claim 1 wherein each of said inclined first-side part of the bottom surface and said inclined second-side part of the bottom surface extend at least twenty percent of a lateral width of the sports board.

13. A sports board according to claim 1, wherein the first side edge portion and the second side edge portion are both curved, the leading edge portion is substantially straight and the following edge portion is substantially straight.

14. A sports board according to claim 1, wherein the sports board is made primarily from a foam material and the bottom surface is formed from a sheet of material adhered to a foam main body part of the sports board.

15. A sports board according to claim 1, wherein the sports board has a board thickness of between 35 mm and 55 mm.

16. A sports board comprising:

a top surface for supporting a rider and a bottom surface;

a leading edge portion and a following edge portion with a central axis of the sports board extending between the leading edge portion and the following edge portion;

a first-side edge portion and a second-side edge portion located on respective first and second lateral sides of the central axis of the sports board;

a plurality of attachment portions; and a towing arrangement comprising at least one elongate member, said towing arrangement being attachable to at least two of said attachment portions;

wherein each of the attachment portions is provided by an attachment structure which extends through an aperture in the sports board; and wherein each attachment structure comprises a head part, which is located on the top surface of the board and which is dimensioned to be unable to pass through the aperture, a tail part which is located on the bottom surface of the board and which is dimensioned to be unable to pass through the aperture, and a connection structure which extends through the aperture and connects the head part and the tail part.

17. A sports board according to claim 16 wherein at least one attachment portion is provided on each lateral side of the central axis and the towing arrangement is attachable to at least one attachment portion which is located on the first lateral side of the central axis and at least one attachment portion which is located on the second lateral side of the central axis.

18. A sports board according to claim 17 wherein the sports board further comprises a handle, and comprises at least three attachment portions, at least two of which are for attachment to said towing arrangement, and at least one of which is for attachment to the handle.

19. A sports board according to claim 18 wherein the sports board comprises at least four attachment portions, at least two of which are for attachment to said towing arrangement, and at least two of which are for attachment to the handle.

20. A sports board according to claim 19 wherein the sports board comprises at least two handles and at least six attachment portions, wherein:

at least two of said attachment portions are for attachment to said towing arrangement;

at least two others of said attachment portions are for attachment to a first handle; and, at least two others of said attachment portions are for attachment to a second handle.

21. A sports board according to claim 20 wherein attachment portions are located adjacent to each of the first and second side edge portions and proximal to the leading edge portion.

22. A sports board according to claim 17 wherein first and second attachment portions for attachment to the towing arrangement are provided symmetrically in relation to the central axis, spaced apart from the central axis, and are proximal to the leading edge portion.

23. A sports board according claim 18 wherein each of said first and second attachment portions for attachment to the towing arrangement are spaced apart from the central axis by a lateral distance which is at least a quarter of a maximum lateral width of the sports board.

24. A sports board according to claim 16, wherein the first-side edge portion and the second-side edge portion are both curved, the leading edge portion is substantially straight and the following edge portion is substantially straight.

25. A sports board according to claim 16, wherein the sports board is made primarily from a foam material and the bottom surface is formed from a sheet of material adhered to a foam main body part of the sports board.

26. A sports board according to claim 16, wherein the sports board has a board thickness of between 35 mm and 55 mm.

* * * * *